US008500405B1

(12) United States Patent
Jones et al.

(10) Patent No.: US 8,500,405 B1
(45) Date of Patent: Aug. 6, 2013

(54) INDUSTRIAL STATOR VANE WITH SEQUENTIAL IMPINGEMENT COOLING INSERTS

(71) Applicant: Florida Turbine Technologies, Inc., Jupiter, FL (US)

(72) Inventors: Russell B Jones, North Palm Beach, FL (US); John A Fedock, Port St. Lucie, FL (US); Gloria E Goebel, Jupiter, FL (US); Judson J Krueger, Jupiter, FL (US); Christopher K Rawlings, Stuart, FL (US); Robert L Memmen, Stuart, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 13/623,291

(22) Filed: Sep. 20, 2012

(51) Int. Cl.
*F01D 5/08* (2006.01)

(52) U.S. Cl.
USPC ..... 416/97 R; 416/96 A; 415/115

(58) Field of Classification Search
USPC ..... 415/115; 416/96 A, 97 R
See application file for complete search history.

(56) References Cited

U.S. PATENT DOCUMENTS

| | | | | |
|---|---|---|---|---|
| 5,165,852 | A * | 11/1992 | Lee et al. | 416/97 R |
| 6,565,312 | B1 * | 5/2003 | Horn et al. | 415/115 |
| 7,568,887 | B1 * | 8/2009 | Liang | 416/97 R |
| 7,901,181 | B1 * | 3/2011 | Liang | 416/97 R |
| 8,257,041 | B1 * | 9/2012 | Liang | 416/97 R |

* cited by examiner

*Primary Examiner* — Edward Look
*Assistant Examiner* — Aaron R Eastman
(74) *Attorney, Agent, or Firm* — John Ryznic

(57) ABSTRACT

A turbine stator vane for an industrial engine, the vane having two impingement cooling inserts that produce a series of impingement cooling from the pressure side to the suction side of the vane walls. Each insert includes a spar with a row of alternating impingement cooling channels and return air channels extending in a radial direction. Impingement cooling plates cover the two sides of the insert and having rows of impingement cooling holes aligned with the impingement cooling channels and return air openings aligned with the return air channel.

15 Claims, 12 Drawing Sheets

INDUSTRIAL STATOR VANE WITH SEQUENTIAL IMPINGEMENT COOLING INSERTS

FEDERAL RESEARCH STATEMENT

This invention was made with Government support under contract number DE-FE0006696 awarded by Department of Energy. The Government has certain rights in the invention.

CROSS-REFERENCE TO RELATED APPLICATIONS

None.

BACKGROUND OF THE INVENTION

1. Field of the Invention

The present invention relates generally to a gas turbine engine, and more specifically to an air cooled turbine stator vane with impingement cooling.

2. Description of the Related Art Including Information Disclosed Under 37 CFR 1.97 and 1.98

In a gas turbine engine, air is first compressed to a high pressure in a compressor. The high pressure air is then mixed with fuel and burned at nearly constant pressure in the combustor. The high temperature gas exhausted from the combustor is then expanded through a turbine which then drives the compressor. If executed correctly, the exhaust stream from the turbine maintains sufficient energy to provide useful work by forming a jet, such as in aircraft jet propulsion or through expansion in another turbine which may then be used to drive a generator like those used in electrical power generation. The efficiency and power output from these machines will depend on many factors including the size, pressure and temperature levels achieved and an agglomeration of the efficiency levels achieved by each of the individual components.

Current turbine components are cooled by circulating relatively (to the gas turbine engine) cool air, which is extracted from the compressor, within passages located inside the component to provide a convective cooling effect. In many recent arrangements, the spent cooling flow is discharged onto the surfaces of the component to provide an additional film cooling effect.

The challenge to cool first stage turbine vanes (these are exposed to the highest temperature gas flow), in particular, is complicated by the fact that the pressure differential between the vane cooling air and the hot gas which flows around the airfoil must necessarily be small to achieve high efficiency. Specifically, coolant for the first stage turbine vane is derived from the compressor discharge, while the hot gas is derived from the combustor exit flow stream. The pressure differential available for cooling is then defined by the extremely small pressure drop which occurs in the combustor. This is because the pressure of the coolant supplied to the vane is only marginally higher than the pressure of the hot gas flowing around the airfoil as defined by the combustor pressure loss, which is desirably small. This pressure drop is commonly on the order of only a few percentage points. Further, it is desirable to maintain coolant pressure inside the vane higher than the pressure in the hot gas flow path to insure coolant will always flow out of the vane and thus keeping the hot gas out. Conversely, in the event hot gas is permitted to flow into the vane, serious material damage can result as the materials are heated beyond their capabilities and progression to failure will be swift. As a consequence, current first stage turbine vanes are typically cooled using a combination of internal convection heat transfer using single impingement at very low pressure ratio, while spent coolant is ejected onto the airfoil surface to provide film cooling.

The efficiency of the convective cooling system is measured by the amount of coolant heat-up divided by the theoretical heat-up possible. A small amount of coolant heat-up reflects low cooling efficiency while heating the coolant to the temperature of the surface to be cooled (a theoretical maximum) yields 100% cooling efficiency. In the previous methods using single impingement, the flow could only be used once to impinge on the surface to be cooled. This restriction precludes the ability to heat the coolant substantially, thereby limiting the cooling efficiency.

U.S. Pat. No. 8,096,766 issued to Downs on Jan. 17, 2012 discloses an AIR COOLED TURBINE AIRFOIL WITH SEQUENTIAL COOLING in which the cooling circuit is formed from an alternating series of plates that are bonded together to form a series of impingement cooling. The bonded plates form an insert that is then inserted into a hollow airfoil to form the sequential impingement cooling circuit. A forward section of the pressure side wall is first cooled by impingement cooling, then collected and impinged on an aft section of the pressure side wall, and then collected to provide impingement cooling on the suction side wall, where the cooling air is collected and then discharged through trailing edge exit holes. The sequential impingement cooling circuit of the Downs patent is a very costly method of forming a cooling circuit for a turbine airfoil. Each plate must be formed by a costly fabrication method and then bonded together to form the completed insert.

BRIEF SUMMARY OF THE INVENTION

A turbine stator vane for an industrial gas turbine engine with two impingement cooling inserts located in a forward section and an aft section of an airfoil to provide improved cooling. A forward impingement insert has three impingement cooling zones that are connected in series. An aft impingement insert has two impingement cooling zones also connected in series. Each impingement insert includes impingement channels and return air channels extending in an alternating series along the radial direction of the insert to cover the airfoil surface for impingement cooling. Each insert is formed as a solid piece with impingement plates bonded over to enclose the impingement channels. Return air openings are formed in the impingement plates to allow for spent impingement cooling air to flow to the next impingement zones.

The impingement cooling inserts have double rows of impingement cooling holes spaced between return air openings so that adjacent impingement cooling holes do not produce a cross-flow as does the prior art impingement cooling designs. A better level of impingement cooling is produced and with a more even spacing of impingement cooling over the airfoil walls.

Each insert is secured to an outer endwall of the vane with a free floating lower end that rides within a sealing cap secured to a bottom side of the inner endwall of the vane. This allows for thermal growth between the insert and the vane.

The impingement zones are separated from one another by radial extending flexible seals. The radial seals are flexible to allow for relative movement between the two slots that form the seal slot for a single radial seal. The flexible seal has an X-shape that forms four contact points against the surfaces of the seal slot in order to allow for relative movement while maintaining the seal contact.

Rows of film cooling holes are positioned around the airfoil to discharge film cooling air over the surfaces of the airfoil not cooled by impingement cooling holes because of the locations of the radial seal slots.

DETAILED DESCRIPTION OF THE INVENTION

The present invention is a turbine stator vane for an industrial gas turbine engine with two sequential impingement cooling inserts that provide impingement cooling to the backside surfaces of the airfoil of the vane. The sequential impingement cooling inserts are especially useful for first stage stator vanes because of the high level of cooling required. The inserts of the present invention provide for a better use of the cooling air that results in equivalent part temperatures with less cooling air than in the prior art vanes with inserts. The sequential cooling design allows for the reuse of the coolant through multiple sequential impingements. The post-impingement pressure is set high enough for coolant outflow through all of the airfoil holes in all regions of the airfoil. The multiple sequential impingement cooling of the present invention enables for better utilization of TBC from high efficiency backside cooling, and increases the hA/Wcp ratio by 280% through the re-use of the cooling air.

Figure 1:
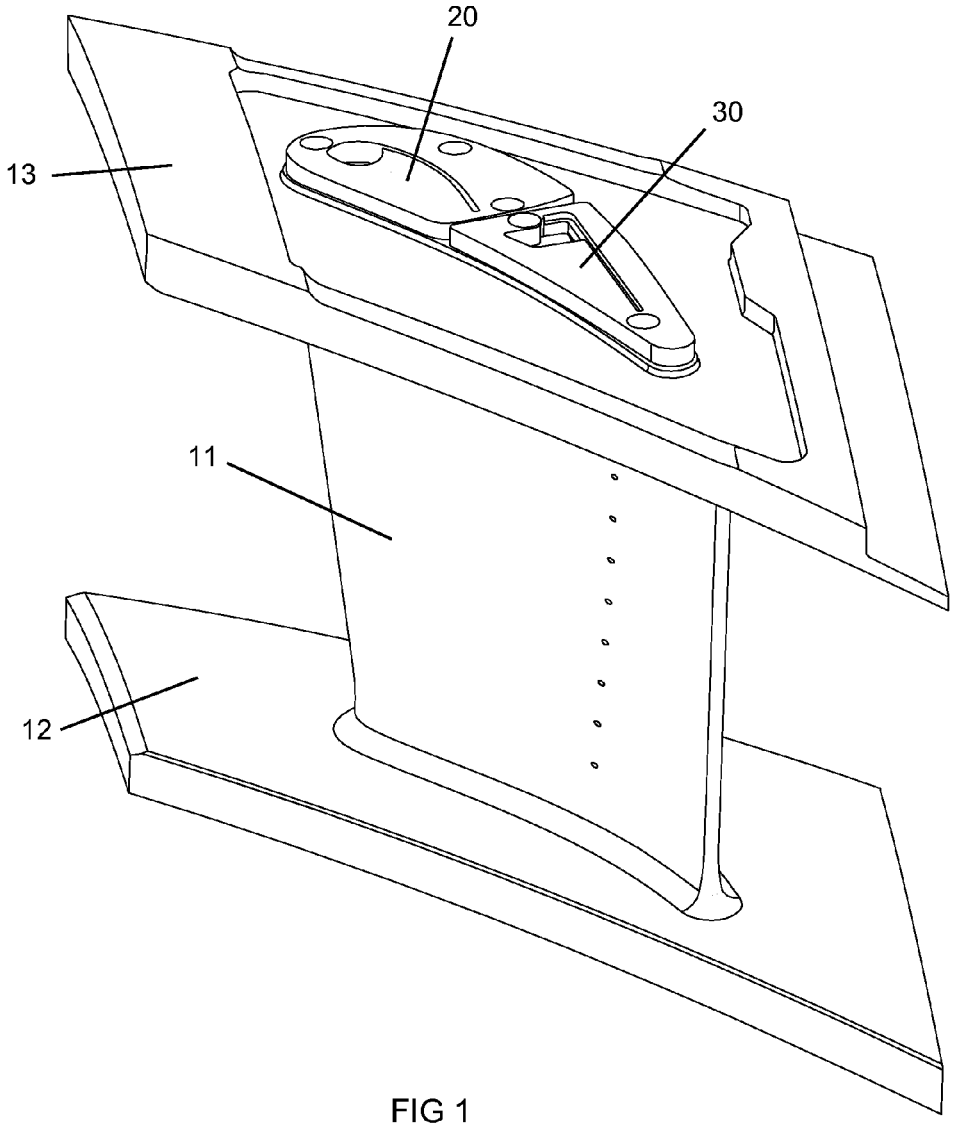
FIG. 1 shows an isometric top view of a turbine stator vane with impingement cooling inserts according to the present invention.
Figure 2:
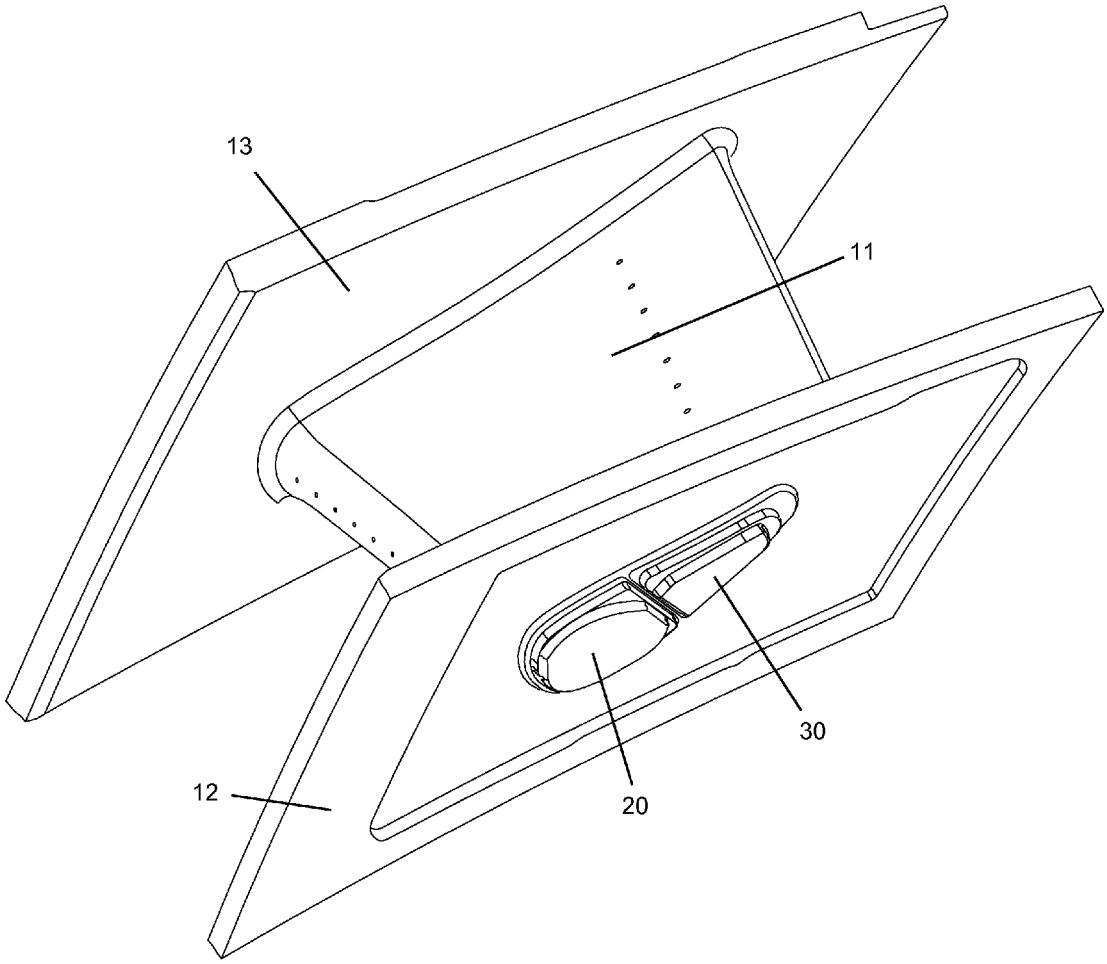
FIG. 2 shows an isometric bottom view of the turbine stator vane with impingement cooling inserts of FIG. 1.

FIG. 1 shows an industrial engine stator vane with two impingement inserts according to the present invention. The stator vane includes an airfoil 11 extending between an inner endwall 12 and an outer endwall 13. A forward impingement insert 20 is located in a forward section of the airfoil 11 and an aft impingement insert 30 is located in an aft section of the airfoil. The two inserts 20 and 30 are solid assemblies that are secured to the outer endwall while being free floating on the inner endwall to accommodate the thermal growth between the vane and the inserts. FIG. 2 shows a view of the vane with the two inserts from a bottom of the inner endwall 12 with the two inserts 20 and 30 free floating within inner endwall cover plates.

Figure 3:
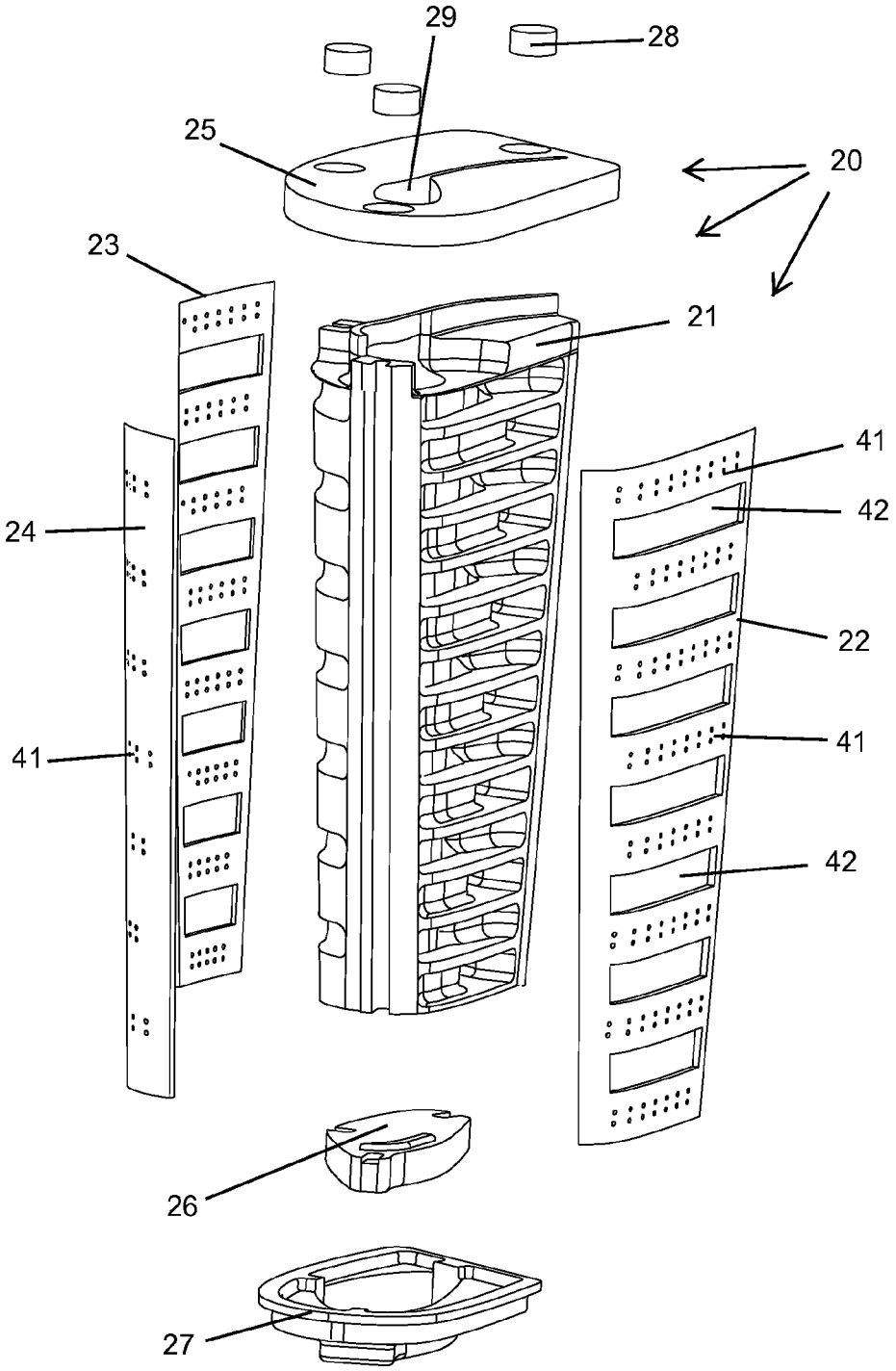
FIG. 3 shows an exploded view of a forward section impingement insert from the pressure wall side of the present invention.

FIG. 3 shows an exploded view of the forward impingement insert 20 from a pressure wall side. The forward impingement insert 20 includes a forward spar 21 in which a series of alternating cooling impingement channels and return channels are formed. The forward spar 21 is formed as a single piece from casting or machining the channels within. This keeps the overall cost of the insert low. In the particular embodiment of the present invention, the forward section of the airfoil is cooled with three impingement zones all connected in series. The forward impingement insert 20 is positioned within the airfoil with three radial extending seals in slots that separate the three impingement zones from one another.

Impingement plates with impingement holes and return air openings are secured onto the forward spar 21. The forward impingement insert 20 includes a pressure wall side impingement plate 22 on the pressure wall side and two impingement plates 23 and 24 on the suction wall side of the insert. Impingement plate 22 covers a first impingement zone along the pressure wall side, impingement plate 23 covers a second impingement zone on an aft side of the forward suction wall side, and impingement plate 24 covers a third impingement zone on a forward side of the forward suction side wall. Each impingement plate includes double rows of impingement holes 41 and return air openings 42.

An outer diameter mounting cap 25 is secured over the forward spar 21 on the outer endwall end, and an alignment rail 26 on the inner diameter is secured on to the forward impingement insert 20 on the inner diameter end. The mounting cap 25 and the alignment rail 26 seal the internal cooling air channels so that the impingement cooling air does not leak out. The mounting cap 25 includes an opening 29 for the supply of cooling air to the forward spar 21. Plugs 28 are used to cover over radial seal access openings formed within the mounting cap 25. Radial seals are inserted through these openings and into position within the radial seal slots and then are covered over by the plugs 28.

The alignment rail 26 is secured to the inner diameter end of the forward spar 21 and moves along together as a unit within an inner diameter sealing cap 27 that is fixed to the inner end wall 12. The forward impingement insert 20 is fixed to the outer endwall 13 (the mounting cap 25 is welded or bonded to the outer endwall 13) but is free to move in a radial or spanwise direction within the inner diameter sealing cap 27.

Figure 4:
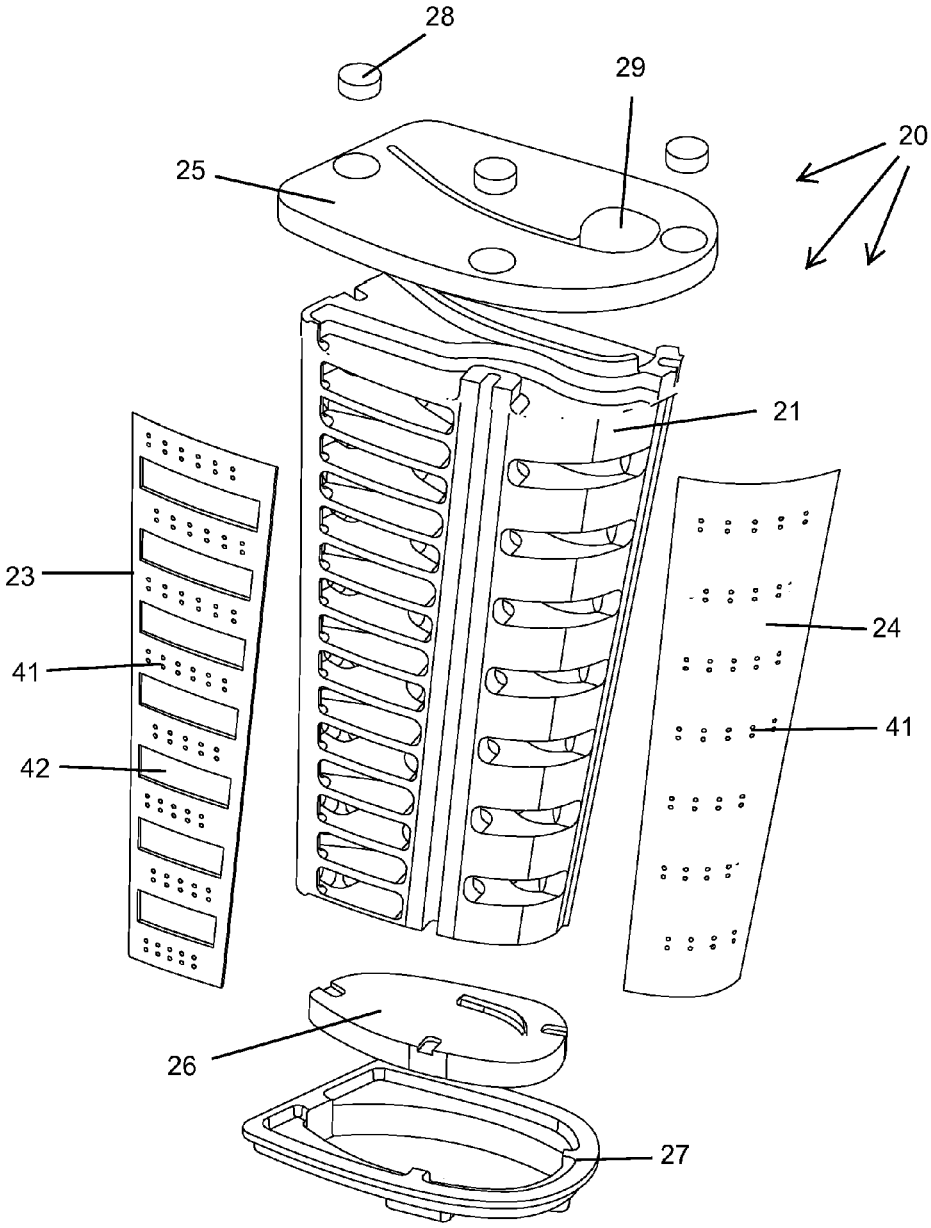
FIG. 4 shows an exploded view of a forward section impingement insert from the suction wall side of the present invention.

FIG. 4 shows the forward impingement insert 20 from the suction wall side with two impingement cooling zones. The second impingement zone is covered by the second impingement plate 23 and the third impingement zone is covered by the third impingement plate 24. The first impingement plate 22 and the second impingement plate 23 both have double rows of impingement cooling holes 41 alternating with return air openings 42. The third and last impingement plate 24 has only double rows of impingement cooling holes 41 with no return air openings 42.

Figure 18:
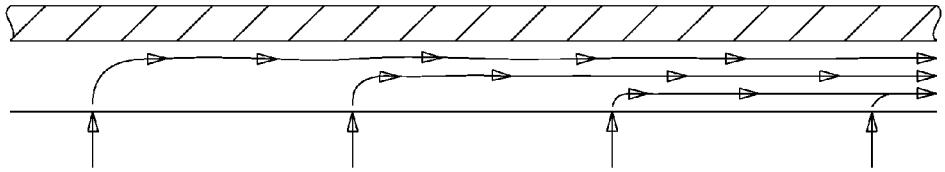
FIG 18 Prior Art
FIG. 18 shows a flow diagram for a row of impingement cooling holes of the prior art.

In order to provide the improved cooling of the airfoil walls, the present invention uses double rows of impingement cooling holes 41 with the return openings 42 on both sides of the double rows of impingement holes 41 to provide a more even impingement cooling and more effective impingement cooling. FIG. 18 shows a prior art arrangement of film cooling holes in a single row. For example, four impingement holes are arranged and discharge against a backside surface of an airfoil wall to be cooled. The first impingement hole produces effective impingement cooling of the wall, and then flows toward a discharge passage. The second impingement holes discharged onto the cooling air flowing from the first impingement hole in which the cooling air flow acts as a blanket of air on which the second impingement cooling air flows on to. The effectiveness of the second impingement cooling air jet has decreased. Now, the first and second impingement cooling air flows toward the discharge passage onto which the third impingement cooling air flows onto. The cooling effectiveness of the third impingement cooling air is even less effective because a layer of cooling air from the first and second impingement cooling holes now provides a larger blanket of cooling air to prevent the third impingement cooling air from producing effective impingement cooling. The buildup of the three upstream impingement cooling air flowing toward the discharge passage is so thick that the fourth impingement cooling air does not even strike the surface of the wall, and thus no impingement cooling takes place. At this impingement hole location, the impingement cooling air just becomes convection cooling air along with the first, second and third spent impingement cooling air.

Figure 17:
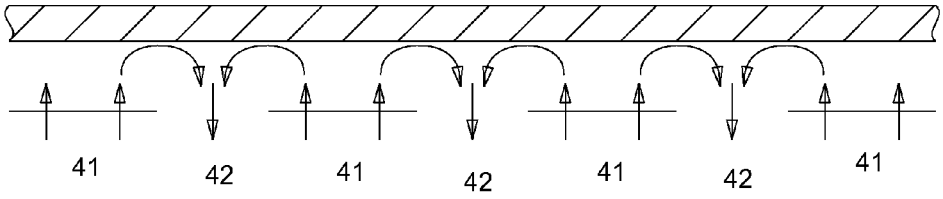
FIG. 17 shows a flow diagram for rows of impingement cooling holes of the present invention spaced between the return air channels.

FIG. 17 shows a representation of the impingement cooling design of the present invention that uses alternating rows of impingement holes 41 and return air openings 42. With the double rows of impingement holes 41 and two return air openings 42 on both sides, the row of impingement holes adjacent to an opening will flow out and strike the wall, and then turn 180 degrees and flow into the adjacent opening 42 without mixing with other impingement cooling air. The return air opening will receive the spent impingement cooling air from the rows of impingement holes adjacent to that opening 42. Thus, all of the impingement cooling air flows out and strikes the wall just ahead and then turns and flows into the return opening. No buildup of spent impingement cooling air occurs that will block or blanket a downstream flow of impingement cooling air.

The forward spar 21 has three impingement cooling zones. Each zone includes impingement cooling air supply channels and return air channels alternating between impingement channels and return air channels in the radial direction of the insert 20. Cooling air supplied to the vane outer endwall flows through the opening in the outer diameter mounting cap 25 and into the cooling air impingement channels formed in the forward spar 21. The impingement cooling holes 41 formed in the impingement plate 22 covers over these impingement cooling channels. The return air channels in the forward spar 21 are covered over by the return air openings formed in the impingement plate 22. The cooling air supplied to the opening in the outer diameter mounting cap 25 then flows into the series of impingement cooling channels and then through the rows of impingement cooling holes in the impingement plate 22 to provide impingement cooling to the backside surface of the airfoil in the first impingement zone that extends along the pressure wall side in the forward section of the airfoil. The spent impingement cooling air from the impingement cooling holes 41 is then collected in the series of return air channels and then flows to the other side of the forward spar 21 to the impingement channels and impingement cooling holes in the second impingement cooling zone that is enclosed by the second impingement plate 23.

Figure 5:
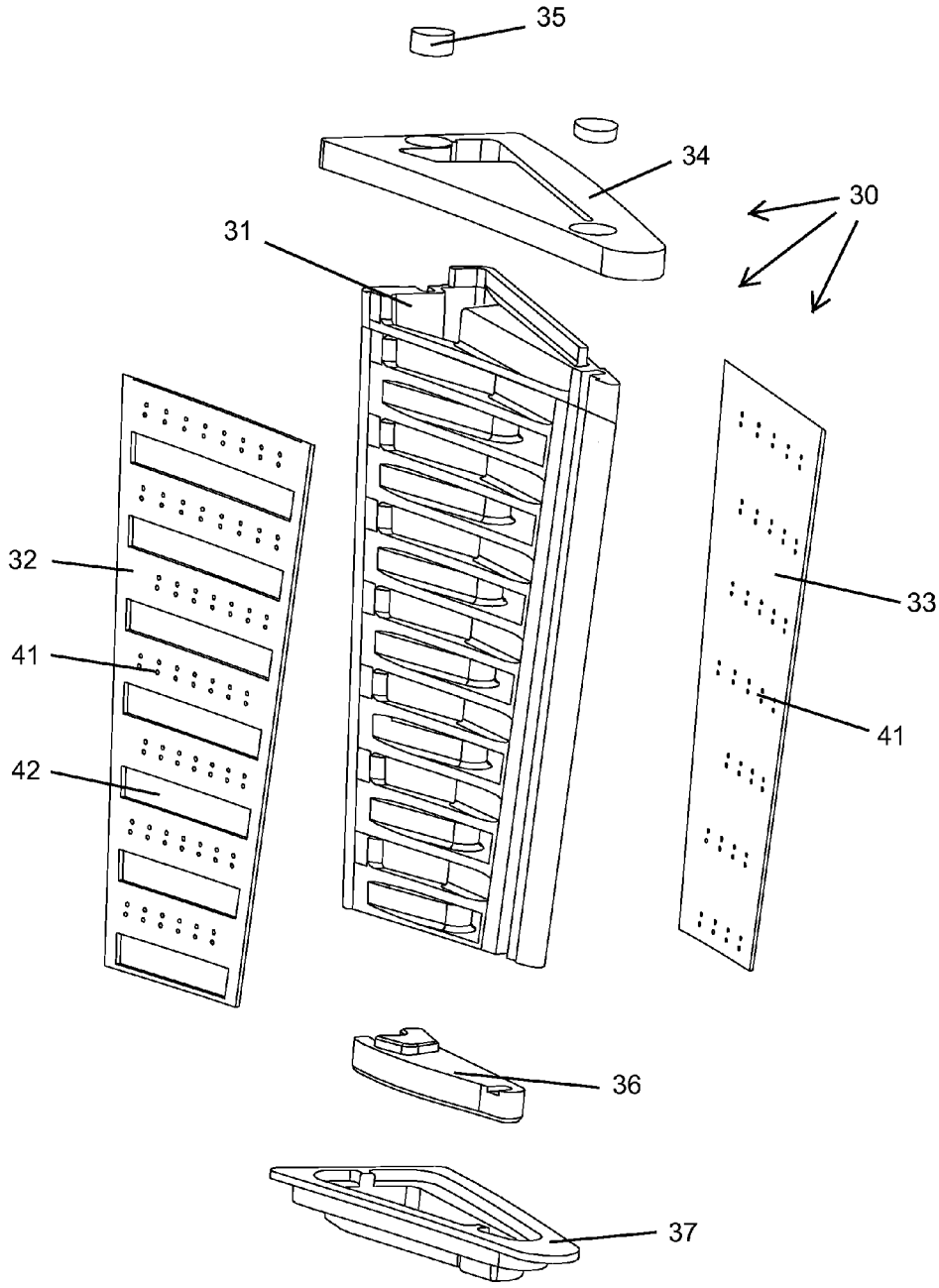
FIG. 5 shows an exploded view of an aft section impingement insert from the pressure wall side of the present invention.

FIG. 5 shows the aft impingement insert 30 from the pressure wall side and includes a aft spar 31 having an alternating series of impingement channels and cooling air return channels spaced along a radial direction, a pressure wall side impingement plate 32 and a suction wall side impingement plate 33, outer diameter mounting cap 34, an alignment rail 36 on the inner diameter end of the spar 31, and an inner diameter sealing cap 37 in which the alignment rail 36 slides within in the radial direction. The mounting cap 34 includes an opening for the supply of cooling air to the spar 31. The mounting cap 34 and the alignment rail 36 enclose the channels formed within the spar 31. The mounting cap 34 secures the impingement insert 30 to the outer endwall of the vane.

The aft insert 30 includes two impingement cooling zones with one zone on the pressure wall side and the second zone on the suction wall side. The two impingement plates 32 and 33 both include double rows of impingement cooling holes 41 spaced between return air openings 42. The mounting plate 34 also includes two openings for the insertion of radial seals into seal slots formed between the insert and the airfoil. Plugs 35 are used to close up the openings after the seals have been inserted into place.

Figure 6:
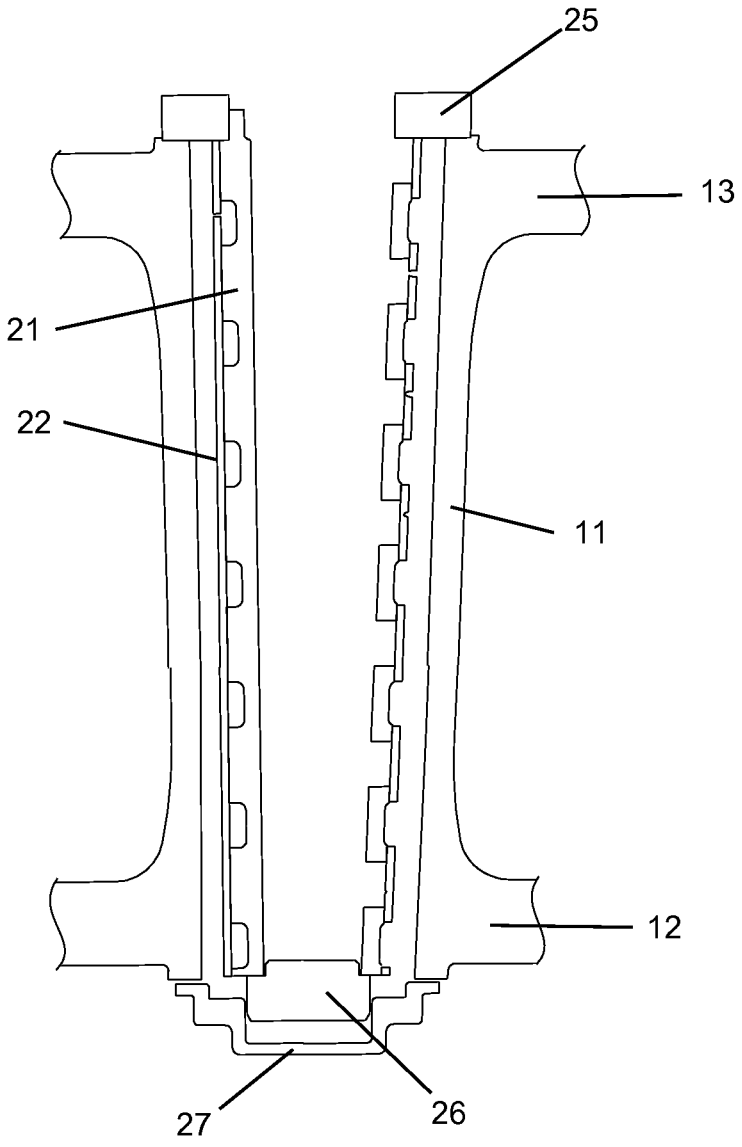
FIG. 6 shows a cross section view of the forward impingement insert positioned within the stator vane according to the present invention.

FIG. 6 shows a cross section view through the forward impingement insert with the airfoil 11 of the vane. The mounting cap 25 is welded to the outer diameter endwall 13 and secures the impingement insert 30 in place. The alignment rail 26 is secured to the spar 21 on the lower end and slides in and out of the sealing cap 27 as the inert shrinks or grows relative to the airfoil 11.

Figure 7:
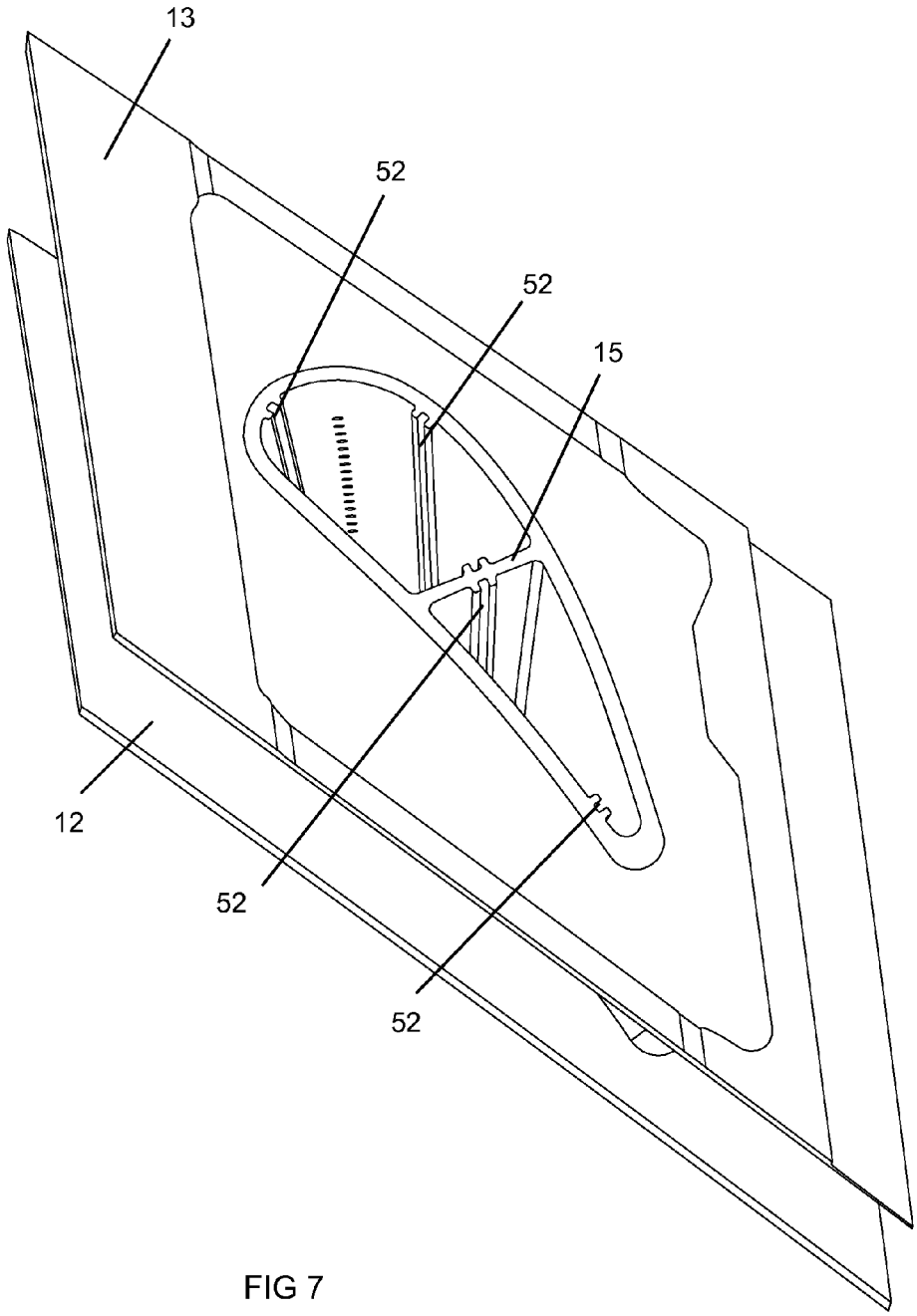
FIG. 7 shows a hollowed out stator vane with radial seal slots which receives the impingement inserts according to the present invention.

FIG. 7 shows the vane with a hollow inside within the inserts 20 and 30. The hollow vane includes a single rib 15 extending from the pressure wall to the suction wall and separates a forward opening from an aft opening in which the inserts are secured. Radially extending seal slots 52 are formed on an inner side of the hollow openings and are aligned with radial seal slots formed on the inserts 20 and 30.

Figure 11:
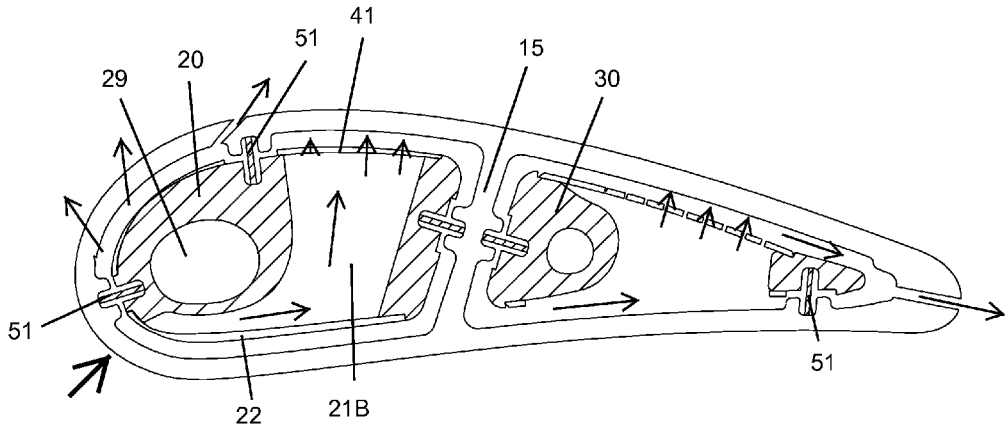
FIG. 11 shows a cross section top view of the stator vane and impingement cooling inserts through a cut in the return air channels.

FIG. 11 shows a cross section top view of the airfoil 11 with the two impingement inserts 20 and 30 inside. The forward impingement insert has three radial extending seal slots that each receives a radial extending flexible seal 51. The radial seals 51 separate the three impingement zones in the forward section of the airfoil where the forward impingement insert 20 is located. The radial seal 51 locations are important. The stagnation line is shown where the heavy arrow strikes the airfoil, and represents the highest external heat load on the airfoil. One radial seal 51 is located on the suction wall side of the stagnation line so that the first impingement zone provides impingement cooling to the hottest section of the airfoil that extends through the stagnation line and toward the rib 15 of the airfoil. The rib 15 is located far enough away from the trailing edge so that the aft impingement insert with the series cooling flow from the pressure side to the suction side wall can be fitted within the aft opening of the airfoil. Another radial seal 51 separates the suction wall side into two impingement zones of about equal lengths. A third radial seal 51 is located around the middle of the rib 15. The rows of film cooling holes are represented by the smaller arrows. One row of film holes is connected to the first impingement zone and discharges out between the radial seal and the stagnation line. This row of film cooling holes provides film cooling to the airfoil wall where the radial seal slot is located. Multiple rows of film holes are located in the third impingement zone to discharge the impingement cooling air with one row located just upstream from the radial seal slot to provide cooling for the airfoil wall at the slot.

The aft impingement insert 30 includes two radial extending seal slots with radial seals 51 therein that separate a pressure side impingement zone from a suction side impingement zone as seen in FIG. 11. One radial seal 51 is located on the pressure side wall toward the downstream end of the insert 30. Two rows of film cooling holes represented by the smaller arrows provide cooling for the wall around the radial seal 51. One row is connected to the pressure side impingement zone, and the second row is connected to the space where the spent impingement cooling air from the suction wall side zone flows before passing through the trailing edge region multiple impingement holes that discharge through exit holes in the trailing edge.

Figure 19:
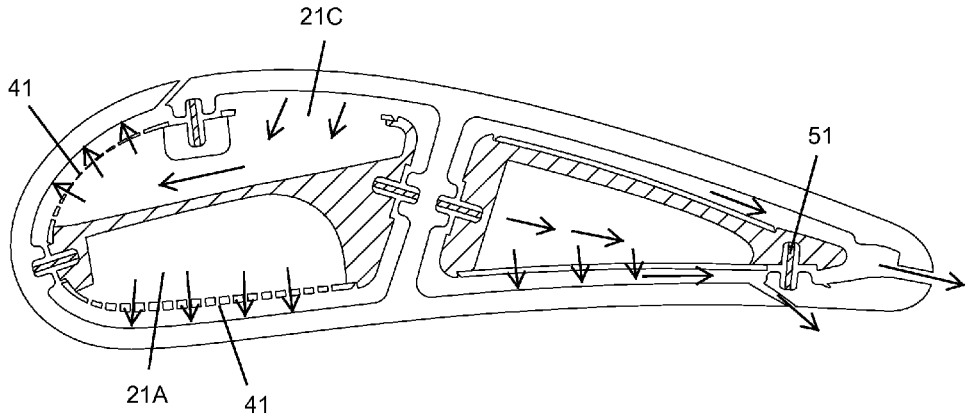
FIG. 19 shows a cross section top view of the stator vane and impingement cooling inserts through a cut in the impingement cooling channels.
Figure 12:
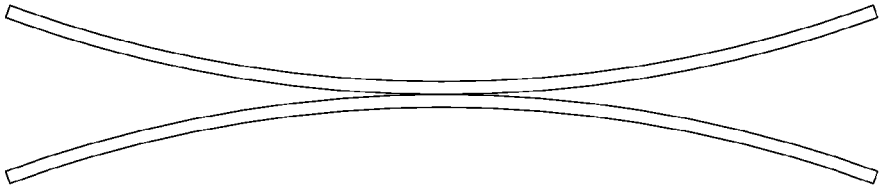
FIG. 12 shows a first embodiment of the flexible seal of the present invention.
Figure 13:
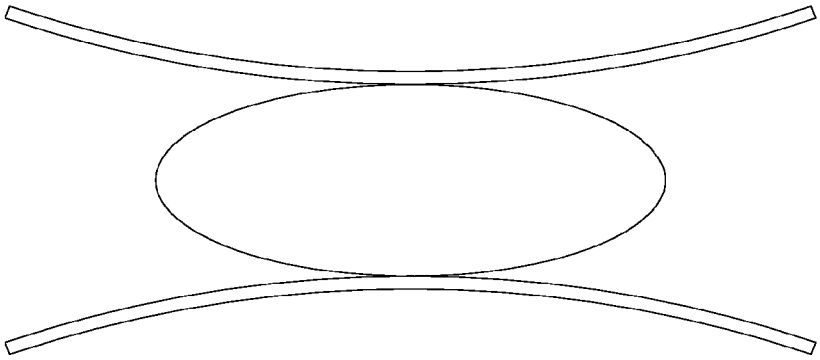
FIG. 13 shows a second embodiment of the flexible seal of the present invention.
Figure 14:
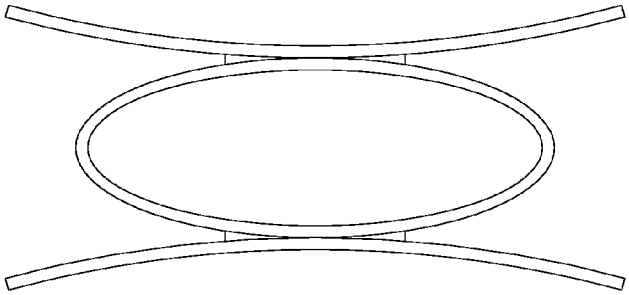
FIG. 14 shows a third embodiment of the flexible seal of the present invention.
Figure 15:
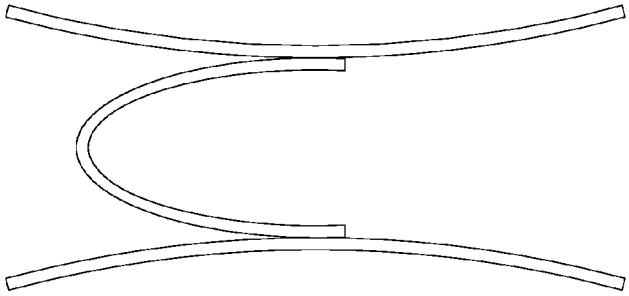
FIG. 15 shows a fourth embodiment of the flexible seal of the present invention.
Figure 16:
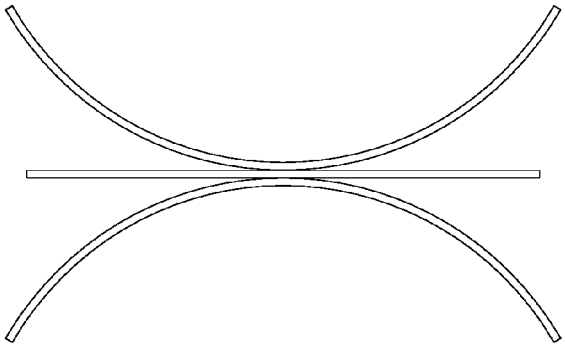
FIG. 16 shows a fifth embodiment of the flexible seal of the present invention.

FIG. 11 shows the inserts through a cut section that shows the return air channels. FIG. 19 shows the inserts through a cut section that shows the impingement channels. Cooling air from the supply channel 29 first flows into the impingement channels 21*a* along the pressure side and then through the impingement holes 41 (see FIGS. 11 and 19) to impinge on the backside of the pressure side wall. The cooling air is then collected in the return air channels 21*b* and flows to the aft section of the suction side where the cooling air then flows through the rows of impingement holes 41 in this section of the airfoil. The cooling air then flows into the return channels on the suction wall side and into the impingement channels with impingement holes 41 in the forward section of the suction side of the insert 20, and then the cooling air is discharged through the rows of film cooling holes out from the airfoil.

In the aft insert 30, the cooling air from the supply channel first flows through the impingement channels and through the impingement holes to the pressure side, then into the return air channels toward the suction side, and then through the impingement holes on the suction side, and then into the return air channels on the suction side where the cooling air then is discharged from the airfoil through trailing edge exit holes.

Figure 8:
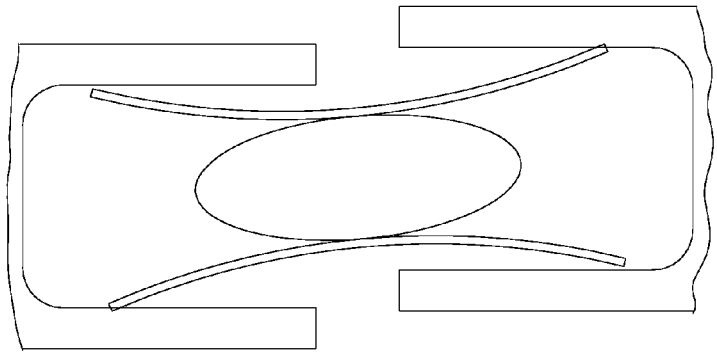
FIG. 8 shows a flexible seal of the present invention mounted in opposed seal slots that are offset.
Figure 9:
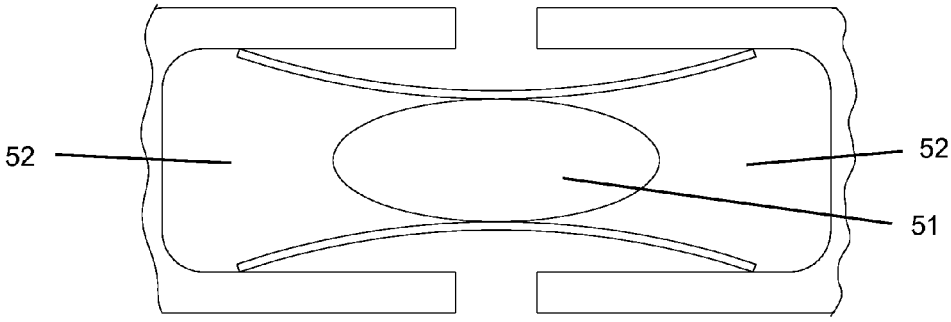
FIG. 9 shows a flexible seal of the present invention mounted in opposed seal slots that are aligned.
Figure 10:
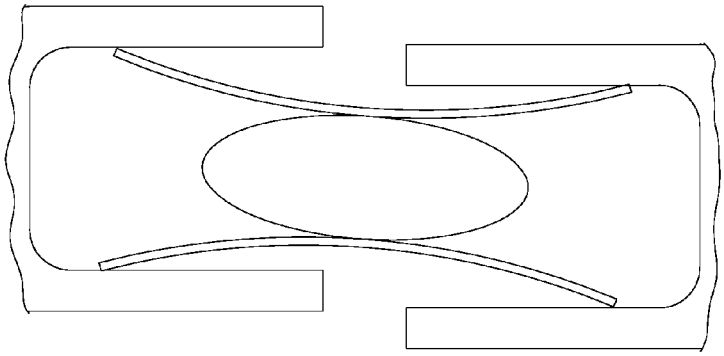
FIG. 10 shows a flexible seal of the present invention mounted in opposed seal slots that are offset in an opposite direction than in FIG. 8.

FIG. 9 shows one radial extending seal slot 52 formed between the airfoil wall and the insert in which a flexible radial seal 51 is located. Because the vane is exposed to high temperature, the opposing radial seal slots 52 can become out of alignment as represented by FIGS. 8 and 10. Therefore, prior art rigid seals do not provide the required sealing to separate the impingement zones so that a cross-over flow does not occur between zones. The flexible seal 51 is formed from two curved halves that form four contact points that form the seal with the slot surfaces. U.S. patent application Ser. No. 13/585,891 filed on Aug. 15, 2012 and entitled SPRING LOADED COMPLIANT SEAL FOR HIGH TEMPERATURE USE discloses more on this radial extending seal and radial slot arrangement, the entire disclosure of which is incorporated herein by reference. With the use of the flexible radial seal 51, the seal slots formed in the airfoil wall and the inserts can be cast instead of machined and the tolerance of the seal slot surfaces can be low due to the seal being so flexible. FIGS. 12 through 16 shows various embodiments of the flexible seal that can be used in the radial extending slots 52 for the impingement inserts 20 and 30.

We claim the following:

1. An industrial engine turbine stator vane comprising:
an airfoil extending between an outer diameter endwall and an inner diameter endwall;
a rib extending across the airfoil from a pressure side wall to a suction side wall and dividing the airfoil into a forward section and an aft section;
a forward impingement cooling insert secured within the forward section of the airfoil;
an aft impingement cooling insert secured within the aft section of the airfoil;
the forward impingement cooling insert forming three impingement cooling zones with a first impingement cooling zone on the pressure side wall and the second and third impingement cooling zones on the suction side wall;
the first and second and third impingement cooling zones are connected in series flow;
the aft impingement cooling insert forming two impingement cooling zones with a fourth impingement cooling zone on the pressure side wall and the fifth impingement cooling zone on the suction side wall;
the fourth and the fifth impingement cooling zones are connected in series flow; and,
both impingement cooling inserts have an alternating series of impingement cooling holes and return air openings that produce impingement cooling and channel spent impingement cooling air to the next impingement cooling zone.

2. The industrial engine turbine stator vane of claim 1, and further comprising:
each impingement cooling insert is formed from a single piece spar with a mounting cap and an alignment rail closing off both ends, and impingement plates having impingement cooling holes and return air openings.

3. The industrial engine turbine stator vane of claim 2, and further comprising:
each mounting cap is secured to the outer diameter endwall of the vane; and,
each alignment rail is free floating within a sealing cap secured to the inner diameter endwall.

4. The industrial engine turbine stator vane of claim 1, and further comprising:
each impingement cooling insert includes a double row of impingement cooling holes with return air openings located above and between the double rows of impingement cooling holes.

5. The industrial engine turbine stator vane of claim 1, and further comprising:
the impingement cooling zones in the two impingement cooling inserts are separated by radially extending seals secured within radial extending seal slots; and,
each radial extending seal is a flexible seal having an X-shape that forms four contact points for making seal contact with surfaces of the seal slot.

6. The industrial engine turbine stator vane of claim 1, and further comprising:
a first radial extending seal located in a leading edge region of the airfoil on a suction side of a stagnation line; and,
a second radial extending seal located on the suction wall side.

7. The industrial engine turbine stator vane of claim 6, and further comprising:

a first row of film cooling holes opening on the airfoil between the stagnation line and the first radial extending seal; and, a second row of film cooling holes opening on the suction side of the airfoil upstream from the second radial extending seal.

8. The industrial engine turbine stator vane of claim 1, and further comprising:

the aft impingement cooling insert having a radial extending seal on a pressure side of an aft end of the insert; and, a row of film cooling holes opening onto the pressure side wall of the airfoil upstream from the radial extending seal.

9. The impingement cooling insert of claim 1, and further comprising:

the suction side of the insert includes a second row of impingement cooling channels and return air channels; and, a pressure side impingement plate with a plurality of rows of impingement cooling holes and a plurality of return air openings secured over the suction side of the spar with the impingement cooling holes aligned with the second row of impingement cooling channels and the return air openings aligned with second row of return air channels; and, the impingement cooling channels and return air channels formed within the spar forming a series cooling flow path from the cooling air supply channel in the spar to a last row of return air channels.

10. An impingement cooling insert for a turbine stator vane comprising:

a spar having a pressure side and a suction side;

a plurality of impingement cooling channels formed on the pressure side and the suction side;

a plurality of return air channels formed on the pressure side and the suction side;

the impingement cooling channels and the return air channels alternating from one to the other in a spanwise direction of the insert;

a pressure side impingement plate with a plurality of rows of impingement cooling holes and a plurality of return air openings secured over the pressure side of the spar with the impingement cooling holes aligned with the impingement cooling channels and the return air openings aligned with the return air channels;

a suction side impingement plate with a plurality of rows of impingement cooling holes secured over the suction side of the spar with the impingement cooling holes aligned with the impingement cooling channels; and, the pressure side return air channels are connected to the suction side impingement cooling channels.

11. The impingement cooling insert of claim 10, and further comprising:

each row of impingement cooling holes is a double row of impingement cooling holes.

12. The impingement cooling insert of claim 10, and further comprising:

a mounting cap secured to a top side of the spar;

the mounting cap having an opening to supply cooling air to the spar;

an alignment rail secured to a bottom side of the spar; and, the mounting cap and the alignment rail close off the spar so that cooling air does not leak out.

13. The impingement cooling insert of claim 12, and further comprising:

the impingement cooling insert includes a radial extending slot for a radial extending seal; and, the mounting cap includes an opening located over the radial extending slot for insertion of a radial extending seal into the slot.

14. The impingement cooling insert of claim 13, and further comprising:

a plug to close the opening in the mounting cap.

15. The impingement cooling insert of claim 10, and further comprising:

the spar is a one-piece spar.

* * * * *